US007162908B2

(12) United States Patent
Manini

(10) Patent No.: US 7,162,908 B2
(45) Date of Patent: Jan. 16, 2007

(54) DEVICE FOR HANDLING THE UPPER MOVING TABLE CARRYING THE PUNCH IN A BENDING PRESS

(75) Inventor: Antonio Manini, Vigolzone (Piacenza) (IT)

(73) Assignee: Schiavi Macchine Industriali S.p.A., Milan (IT)

( * ) Notice: Subject to any disclaimer, the term of this patent is extended or adjusted under 35 U.S.C. 154(b) by 309 days.

(21) Appl. No.: 10/846,659

(22) Filed: May 17, 2004

(65) Prior Publication Data

US 2005/0252270 A1 Nov. 17, 2005

(51) Int. Cl.
*B21J 9/18* (2006.01)
*B21D 5/00* (2006.01)

(52) U.S. Cl. ..... 72/390.4; 72/390.5; 72/389.3; 100/258 R; 100/282

(58) Field of Classification Search ..... 72/389.3, 72/390.4, 390.3, 390.5; 100/258 R, 282
See application file for complete search history.

(56) References Cited

U.S. PATENT DOCUMENTS 1,407,161 A * 2/1922 Klocke ..... 100/282
2,185,096 A * 12/1939 Treer ..... 72/446
2,807,206 A * 9/1957 Saives ..... 100/258 A
4,013,003 A * 3/1977 Finsterwalder et al. ..... 100/285
4,318,295 A * 3/1982 Sindelar ..... 72/450
6,240,758 B1 6/2001 Nagakura
6,595,125 B1 * 7/2003 Kawado et al. ..... 100/282
6,655,267 B1 * 12/2003 Mukai et al. ..... 100/258 R

FOREIGN PATENT DOCUMENTS

| | | |
|---|---|---|
| DE | 845 334 | 7/1952 |
| GB | 991095 | 5/1965 |
| SE | 448 686 | 3/1987 |

* cited by examiner

*Primary Examiner*—David Jones
(74) *Attorney, Agent, or Firm*—Young & Thompson

(57) ABSTRACT

The invention deals with the field of bending presses, and, more precisely, deals with a device for handling the upper table moving along guiding pillars and carrying the punch. For every table guiding pillar, the device provides for a main lever (10) hinged in a point that is substantially axial with its related guiding pillar and whose driving arm (10*a*) is hinged to means sliding along a rod hinged to the upper table. The lever resisting arm (10*b*), whose length is approximately 8–10 cm shorter that the driving arm length, rotates a crank (12) connected through an eccentric (13) or a connection rod to a connecting rod (14) that transmits the translating motion to the upper table.

12 Claims, 2 Drawing Sheets

DEVICE FOR HANDLING THE UPPER MOVING TABLE CARRYING THE PUNCH IN A BENDING PRESS

BACKGROUND OF THE INVENTION

The present invention is a device for handling the upper moving table carrying the punch in a bending press.

DESCRIPTION OF THE RELATED ART

As known, the bending presses have a structure that is mainly composed of a lower table on which tools (matrix dies) rest and an upper table that supports the punches to perform a bend on the sheet that is placed onto the matrix die.

The upper table is moved by thrust actuators consisting in two hydraulic cylinders controlled by an hydraulic unit.

The thrust actuators must carry out an approaching stroke of the two tables at high speed in order to reduce the time necessary for approaching to a minimum.

In the currently marketed bending presses with hydraulic actuators composed of two cylinders, the quick approaching phase exploits the force of gravity in order to make the upper table fall; during the pressing operation, the slow speed is realised by suitably dimensioning flow rate and pressure of the hydraulic unit pump.

The handling system of the hydraulic type has several inconveniences, among which:

due to the internal friction effect of thrust cylinders, the upper table free fall occurs with very low accelerations, with consequent loss of time;

the hydraulic system provides for the use of high amounts of oil with great burdens for user customers as regards maintenance, installation and spent oil disposal.

SUMMARY OF THE INVENTION

An object of the present invention is completely removing all inconveniences due to the use of an hydraulic system by realising an handling device of the upper table of the electro-mechanical type.

This and other objects are fully obtained by the device of the present invention, that is characterised in that it provides what is stated in the below-listed claims, and particularly in that, for every pillar guiding the vertical translation of the punch-carrying upper table, it comprises a main lever axially hinged to the pillar and whose driving arm is hinged onto means translating along a bar hinged to the head and it further comprises a crank, a connecting rod, hinged to the upper table, being hinged to the crank eccentric, the crank being rotated by the main lever resisting arm.

BRIEF DESCRIPTION OF THE DRAWINGS

These and other characteristics will be better pointed out by the following description of a preferred embodiment, shown merely as a non-limiting example in the enclosed tables of drawing, in which.

DESCRIPTION OF THE PREFERRED EMBODIMENTS

Figure 1:
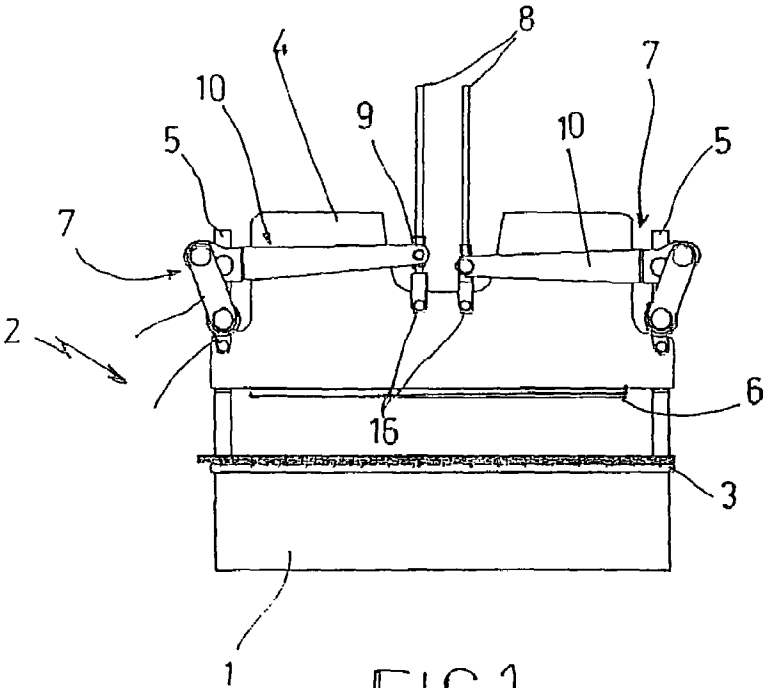
FIG. 1 schematically shows the bending press in a front elevation view

With reference to FIG. 1, number 1 shows a lower table of a bending press designated as a whole as 2.

The lower table has a matrix die 3 on which a sheet foil to be bent is rested.

Number 4 designates an upper table that can vertically translate along guiding pillars 5 in order to go from a top dead center to a bottom dead center and vice versa.

The tool or punch 6, adapted to press onto the sheet next to the below matrix die to perform the bending, is assembled onto the upper table.

Number 7 designates two perfectly identical devices for moving the upper table.

Each one of said devices comprises a threaded bar 8 that can be rotated by an electric ratio-motor 18.

A scroll 9, adapted to translate along the threaded bar when this latter one is rotated, is inserted on the threaded bar.

The threaded bar rotates free with respect to a U-bolt 15 hinged to the upper table in a central position 16 with respect to the guiding pillars.

The threaded bar is a rod hinged to the upper table along which displacing means of a main lever 10 car slide.

The driving arm 10*a* of the main lever 10, hinged in 11 next to the guiding pillar 5 axis, is hinged to the scroll.

A crank 12 is hinged to the resisting arm 10*b* of the main lever 10, such crank 12 having an eccentric 13 to which a connecting rod 14 is hinged, such connecting rod transforming the crank rotating motion into a rectilinear translating motion and transmitting this latter one to the upper table in the way that will be described below with reference to FIGS. 2, 2A, 3, 3A,4 and 4A.

Figure 2A:
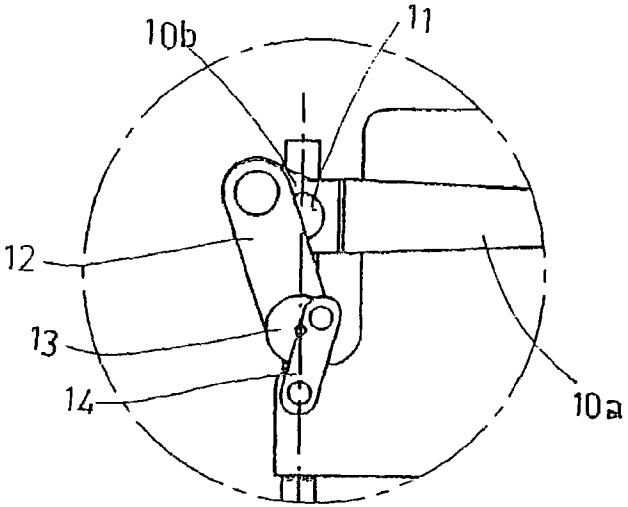
FIGS. 2 and 2A show the press and its related detail with the handling device in its top dead center in the approaching starting step.
Figure 2:
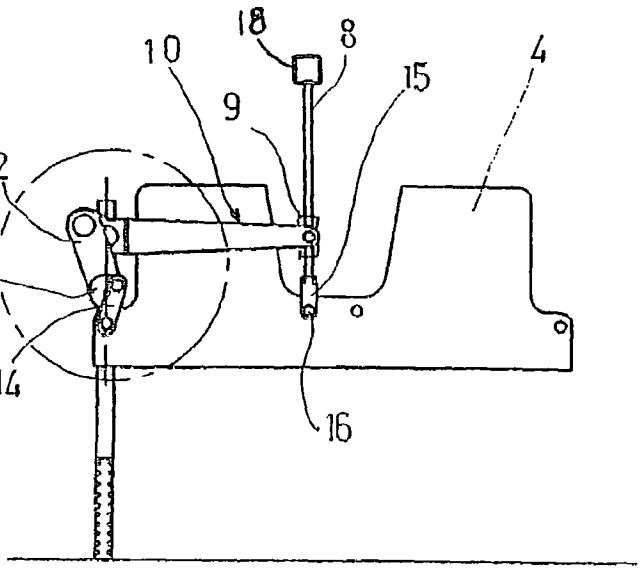
Figure 4A:
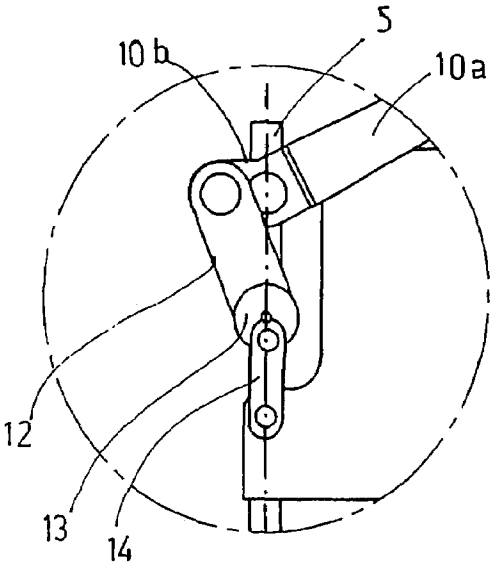
FIGS. 4 and 4A show the press and its related detail in the pressing ending point and at the beginning of the return step to the top dead center.
Figure 4:
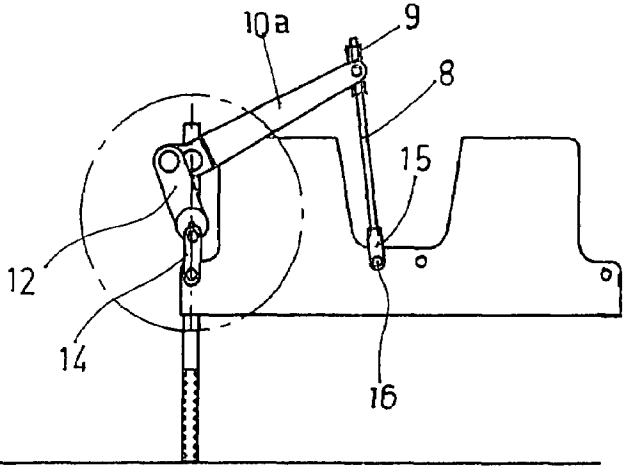

With reference to FIGS. 2 and 2A, the upper table is in the top dead center in the starting position of the quick approach step.

Figure 3A:
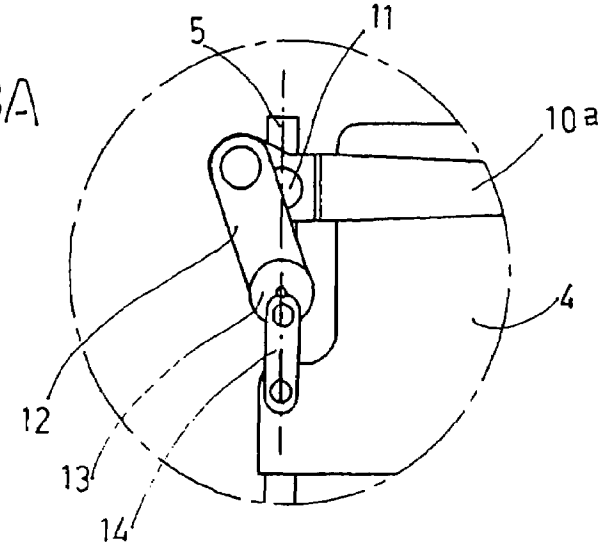
FIGS. 3 and 3A show the press and its related detail in the speed change point during the pressing starting step.
Figure 3:
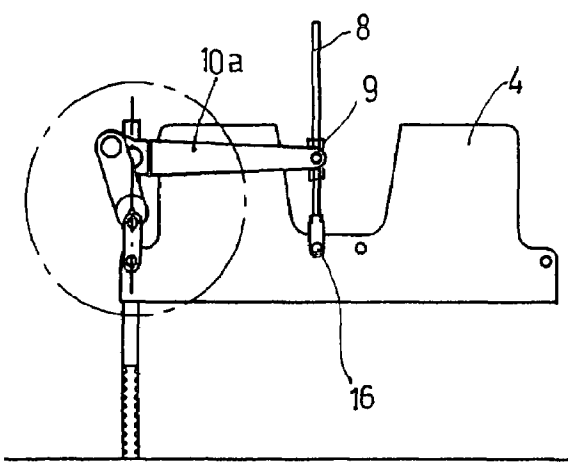

By rotating the threaded bar, the upper table of the bending press will perform the quick descent step, such descent being controlled by the threaded bar and by the connecting rod-crank system, till the connecting rod is taken into a substantially vertical position axial with the guiding pillars. During this quick descent step, the main lever is not subjected to rotations, but a simple vertical translation by moving its rotating point only, as shown in FIGS. 3 and 3A.

The pressing step then begins through the action of the main lever that highly reduces the table descent speed, highly increasing the thrust force.

As can be noted, the two main lever arms are in a ratio of about 8–10 so that a thrust multiplication of this ratio on the table will be obtained.

A further advantage of the present invention is that the two threaded bars directly push onto the upper table in a substantially central position, thereby reducing the table flexure, during the pressing step.

Moreover, since two different mechanical systems are provided for the two table movements (quick and slow ones), from the machine safety point of view, active optical barriers can be provided for the high approaching speed and the lack of protection at the slow pressing speed.

The threaded bar with scroll could be replaced by other translating means of the main lever resisting arm, such as, for example a slider sliding along a rack.

According to a possible embodiment variation, not shown, the eccentric could be replaced by a rod hinged on one side to the connecting rod and on the other side to the crank.

Obviously, the ratio between main lever driving arm and resisting arm can change depending on the thrust that has to be exerted onto the upper table.

The invention claimed is:

1. Device for moving a movable upper table carrying a punch of a bending press and slidable along two guiding pillars (5), comprising:

two devices (7) for moving the upper table along two associated guiding pillars (5), with one device associated with each guiding pillar, each device comprising a rod (8) hinged to the upper table;

a part (9) translatable along the hinged rod;

a main lever (10) hinged next to a vertical axis of the associated guiding pillar, the main lever (10) comprising a resisting arm (10*b*) attached to a driving arm (10*a*), the driving arm (10*a*) hinged to the translatable part;

an eccentric (13) connected to a connecting rod (14), the connecting rod adapted to transmit rectilinear translating motion to the upper table;

a crank (12) hinged, through the eccentric (13), to the connecting rod (14), said crank being rotated by the resisting arm (10*b*) of the main lever (10), wherein, the hinged rod (8) is a threaded bar rotated by a ratio-motor, and the part translatable along the hinged rod is a scroll (9) slidable along the threaded bar rotated by the ratio-motor.

2. Device according to claim 1, wherein, the threaded bar of each device is located at a central location of the upper table.

3. Device according to claim 1, wherein a ratio between a length of the driving arm and a length of the resisting arm is about 8–10 times.

4. A press, comprising:

an upper press table (4);

guiding pillars (5), the upper table vertically translatable along the guiding pillars in order to go i) from a top dead center to a bottom dead center and ii) from the bottom dead center to the top dead center;

two devices (7) operatively connected for moving the upper table along the guiding pillars, each said device comprising a rotatable threaded bar (8), and a scroll (9) adapted to translate along the threaded bar when the threaded bar is rotated.

5. The press of claim 4, further comprising:

a bolt (15) hinged to the upper table, wherein, the threaded bar is connected to the upper table via the bolt, the scroll is inserted on the threaded bar, and the threaded bar rotates freely with respect to the hinged bolt.

6. The press of claim 4, wherein, the threaded bar is a rod hinged to the upper table, and a main lever (10) is connected to the scroll.

7. The press of claim 6, wherein, the main lever comprises a driving arm hinged (11) next to an axis of a corresponding one of the guiding pillars.

8. The press of claim 7, wherein, the main lever further comprises a resisting arm (10*b*), the resisting arm hinged at the axis of the corresponding guiding pillar, and a crank (12) is hinged to the resisting arm, the crank having an eccentric (13) hinged to a connecting rod (14), the connecting rod transforms rotating motion of the crank into a rectilinear translating motion transmitted to the upper table.

9. The press of claim 8, wherein, rotating the threaded bar descends the upper table until the connecting rod is taken into a substantially vertical position axial with the driving pillars.

10. A device for moving a press upper table, comprising:

two devices (7) for moving a press upper table along two associated guiding pillars (5), with one device associated with each of the guiding pillars, each device comprising a rotatable threaded bar (8) hinged to the upper table;

a scroll (9) translatable along the threaded bar upon rotation of the threaded bar;

a main lever (10) hinged along a vertical axis of the associated guiding pillar, the main lever (10) comprising a resisting arm (10*b*) attached to a driving arm (10*a*), the driving arm (10*a*) hinged to the scroll;

an eccentric (13) connected to a connecting rod (14), the connecting rod adapted to transmit rectilinear translating motion to the upper table; and a crank (12) hinged, through the eccentric (13), to the connecting rod (14), said crank being rotated by the resisting arm (10*b*).

11. Device according to claim 10, wherein, the threaded bar of each device is located at a central location of the upper table and is rotatable by a ratio motor.

12. Device according to claim 10, wherein a ratio between a length of the driving arm and a length of the resisting arm is about 8–10.

* * * * *